United States Patent [19]

Moser et al.

[11] 4,049,249

[45] Sept. 20, 1977

[54] TILTABLE CONVERTER

[75] Inventors: Peter Moser; Manfred Eysn; Bernhard Enkner; Rupert Berger, all of Linz; Wolfgang Wagner, Vienna; Ronald Spannlang, Linz, all of Austria

[73] Assignee: Vereinigte Osterreichische Eisen - und Stahlwerke - Alpine Montan Aktiengesellschaft, Linz, Austria

[21] Appl. No.: 639,245

[22] Filed: Dec. 9, 1975

[30] Foreign Application Priority Data

Mar. 12, 1975 Austria ..... 1891/75

[51] Int. Cl.[2] ..... C21C 5/42

[52] U.S. Cl. ..... 266/247

[58] Field of Search ..... 266/245-247; 292/201

[56] References Cited

U.S. PATENT DOCUMENTS

| | | | |
|---|---|---|---|
| 2,834,504 | 5/1958 | Annicq | 292/201 X |
| 3,307,841 | 3/1967 | Lixenfeld | 266/247 |
| 3,350,082 | 10/1967 | Lambrecht et al. | 266/247 |
| 3,430,941 | 3/1969 | Lambrecht et al. | 266/247 |
| 3,632,098 | 1/1972 | Puhringer | 266/247 |
| 3,652,071 | 3/1972 | Gruber | 266/247 |
| 3,805,693 | 4/1974 | Neitzel et al. | 292/201 X |

*Primary Examiner*—Gerald A. Dost

*Attorney, Agent, or Firm*—Brumbaugh, Graves, Donohue & Raymond

[57] ABSTRACT

A tiltable-converter supporting mechanism with drawing hooks which engage with bearing bushing bolting pieces and are actuated by pressure medium cylinder means has self-locking bracing means holding the engaging drawing hooks in a locked position.

8 Claims, 9 Drawing Figures

TILTABLE CONVERTER

BACKGROUND OF THE INVENTION

The invention relates to a tiltable crucible or converter with supporting trunnions fixed to the converter shell and a bearing structure surrounding at least half of the circumference of the converter shell, wherein the supporting trunnions are arranged in bearing bushings that are releasably connected to the bearing structure.

According to U.S. Pat. No. 3,652,071 it has been known to attach bearing bushings to a bearing structure by means of drawing hooks which are pivotable into and out of an engagement position. The drawing anchor connection between the converter and the bearing structure releasable and connectable, respectively, by hand. For releasing and making the connection, a number of service men are necessary in the immediate vicinity of the converter. For safety purposes, however, work at the converter or at its bearing structure ought to be prevented, if possible. Furthermore, the time necessary for releasing or actuating the drawing hooks as well as for tightening and loosening the turnbuckles securing these drawing hooks, constitutes a period of standstill of the converter.

Summary of The Invention

The invention aims at preventing these disadvantages and has as its object to create a converter connection which can be actuated without manipulation in the converter vicinity and which can be completely secured in the engagement position.

This object is achieved by improving the construction described in U.S. Pat. No. 3,652,071 in that for actuating the drawing hooks in and out of the engagement position with a bearing bushing bolting piece, a pressure medium cylinder is provided. On the one hand the pressure medium cylinder is hinged to the bearing structure and, on the other hand, it is connected directly or hinged via a linkage to the drawing hooks. The drawing hooks, when in the engagement position, are maintained in a locked position by self-locking bracing means attached to the bearing structure. Because of the self-locking bracing means, it is possible to maintain the pressure medium cylinders, which pivot the drawing hooks into and out of engagement position, free from pressure during operation of the converter.

Suitably the bearing bushing bolting piece is pivotably arranged at the bearing structure and by means of a pressure medium cylinder it can be brought into and out of an engagement position with the bearing bushings.

Advantageously, the drawing hook is arranged to be pivoted around an axis located on the bearing structure between its hook end and its shaft end. The hook end can be brought into engagement with the bearing bushing bolting piece and the shaft end is hinged to one end of a push rod. The other end of the push rod is guided in a guide and is movable into a locked position along this guide by means of a pressure medium cylinder.

According to another embodiment of the invention drawing hooks are arranged on both sides of the supporting trunnions. The shaft ends of the two opposing drawing hooks are articulately connected with each other by two push rods and the push rods are movable with their common joint along a guide into a locked position by means of pressure medium cylinder means.

With this arrangement it has proved to be especially advantageous for the push rod to be supplied with springs that act in the direction of pressure and, when the drawing hooks are in the engagement position, for the push rod to be movable beyond its dead position into a locked position which automatically prevents the movement of the drawing hooks.

According to a further preferred embodiment, the hook end of a drawing hook is adjustable by means of a pressure medium cylinder toward a bracket (console) of the bearing housing bolting piece and the shaft end of the drawing hook is movable along a guide into the locked position by means of a self-locking mechanical drive, such as a turnbuckle or a knuckle lever. The advantage of this embodiment is that the drawing hooks are exposed to tensile stresses only and not to bending stresses.

In a modified embodiment of the invention, instead of the supporting trunnions and the bearing bushings, claw-like consoles, that are connected to the converter wall and have fitting surfaces, are provided as bearing elements of the converter, and the drawing hooks are brought into and out of engagement by them.

BRIEF DESCRIPTION OF THE DRAWINGS

In order that the invention may be more fully understood, a few embodiments thereof shall now be described by way of examples and with reference to the accompanying drawings in which:

FIG. 3 is a section along line III—III of FIG. 2, FIG. 4 is a section along line IV—IV of FIG. 1, and FIG. 5 is a longitudinal section of a push rod.

DESCRIPTION OF EXEMPLARY EMBODIMENTS

Figure 1:
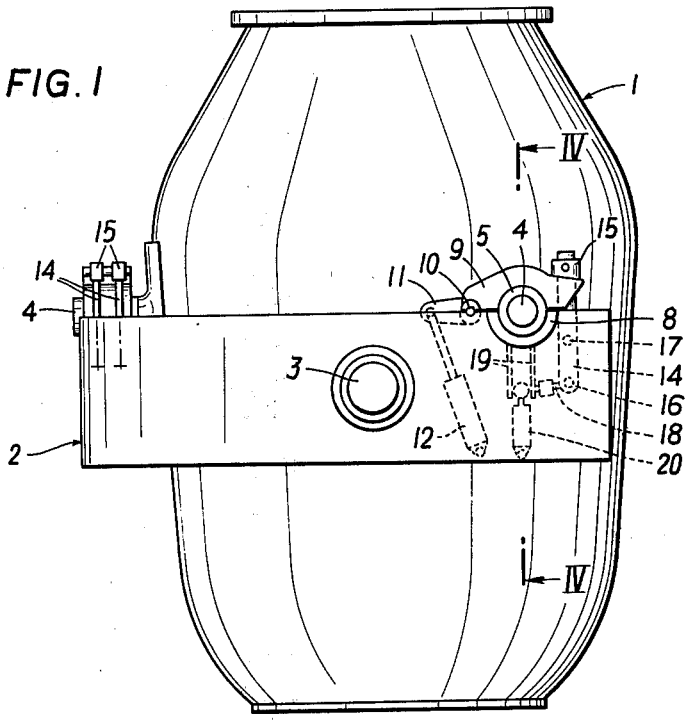
FIG. 1 is a front view of a converter that is releasably connected to its bearing structure.
Figure 2:
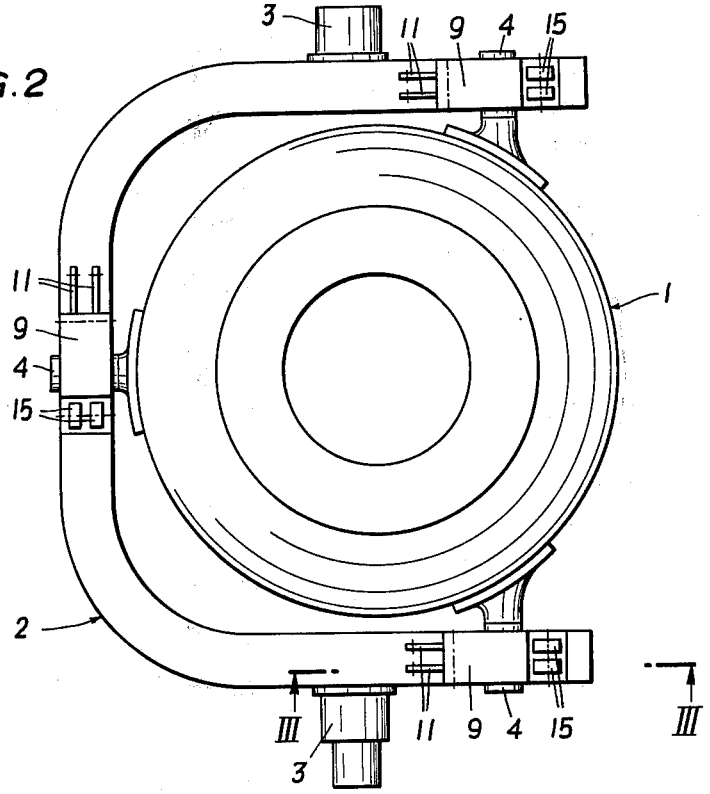
FIG. 2 is a ground plan thereof.

In FIGS. 1 and 2 the converter is denoted with 1, its bearing structure with 2. The bearing structure 2 is horseshoe-shaped, but it can also be closed, and it is connected to the converter tilting trunnion 3. At the converter shell, supporting trunnions 4 are attached so as to convey the weight of the converter onto the bearing structure 2. Three supporting trunnions are provided and the radial planes extending through them enclose angles of about 120° ; thus the converter is mounted in a statically defined manner at three points.

The supporting trunninons 4 are surrounded by bearing bushings 5 which are releasably connected to the bearing structure 2. The bearing bushings 5 comprise an inner sleeve 6 and an outer sleeve that rests on the bearing structure 2 along a fitting surface on the top thereof. This fitting surface is formed by the inner face of a bearing half-shell 8 which is inserted into a recess in the bearing structure 2 having a semi-circular cross-section 2.

Figure 3:
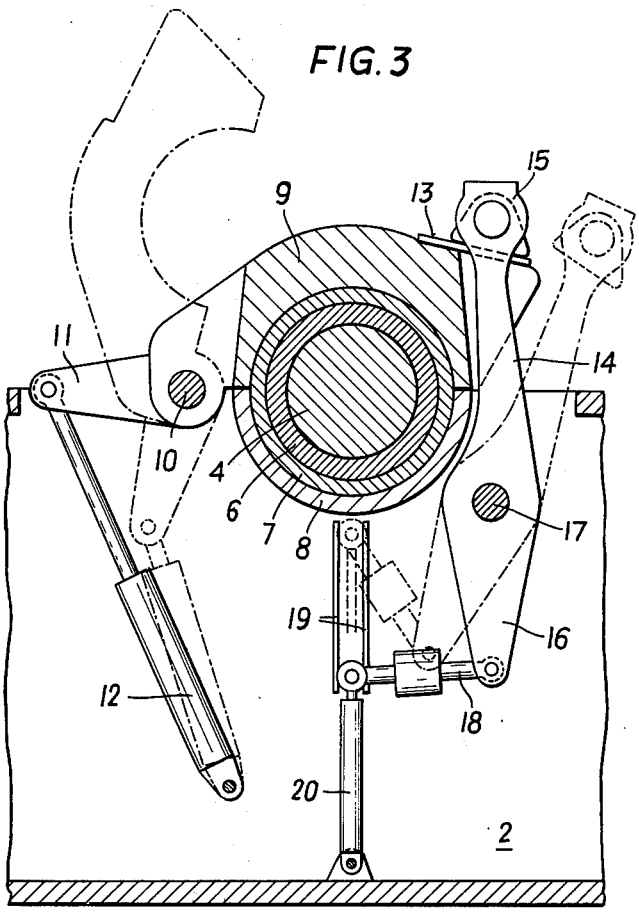
FIGS. 3 to 5 show details of the connection between the converter and the bearing structure of the first embodiment shown in FIG. 1 on a larger scale, i.e.

A bearing bushing bolting piece 9, shown in more detail in FIG. 3, is arranged to pivot around a bolt 10 in the carrying structure and in the engagement position encloses the half of the bearing bushings 5 extending from the bearing structure. The bearing bushing bolting piece 9 comprises two lever-like extensions 11, at whose ends the piston rod of a pressure medium cylinder 12 engages. With the help of this pressure medium cylinder the bearing bushing bolting piece is pivotable, so that the bearing bushings are open toward their upper side and the converter can be lifted from the bearing structure. The open position of the bearing bushing bolting piece is shown in FIG. 3 in broken lines. The bearing bushing bolting piece further comprises at its upper side a fitting surface 13. The hook end 15 of a drawing hook 14 that is arranged to pivot about a bolt 17 at the bearing structure can engage with this fitting surface 13. The shaft end 16 of the drawing hook 14 which is opposite the hook end, is hinged to one end of a push rod 18, which has its other end guided in a track guide 19 and is movable along this guide by means of a pressure medium cylinder 20.

Figure 5:
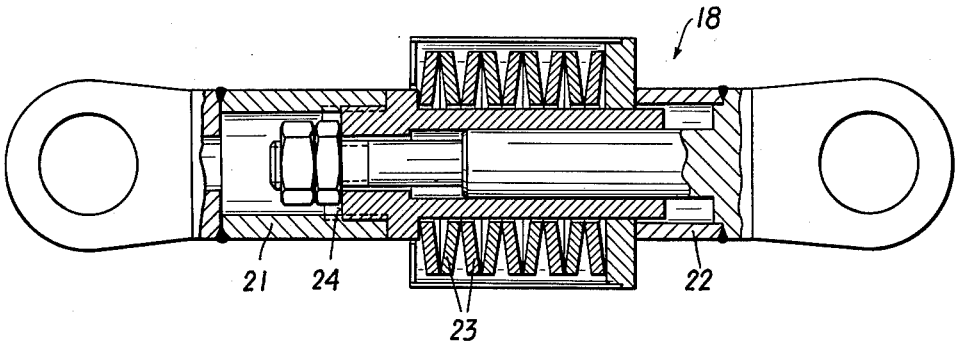

The push rod 18 in FIG. 5 comprises two telescope-type parts, 21 and 22, that are movable with respect to each other and which are pressed away from each other toward their stop surfaces 24 by means of saucer springs 23. As a result the push rod, when subjected to tensile forces, has an unchangeable length, while when subjected to compressive forces, the saucer springs become active. When the drawing hook 14 is in the engagement position — i.e. the position, in which the hook end of the drawing hook is well set on the bearing bushing bolting piece; then the push rod 18 is at a point shortly before its dead position, i.e. shortly before that position in which the axis of the push rod forms a right angle with the axis of the guide 19. If the push rod 18 is now moved into the dead position and a bit further to the end position of the pressure medium cylinder 20, the push rod shortens, and its saucer springs 23 become active. In this locked position, which is illustrated in FIG. 3 in full lines, the drawing hook 14 is pressed by the saucer springs of the push rod 18 against the bearing bushing bolting piece 9 and cannot be disengaged from the bolting piece 9 by any force directly acting upon it. The pressure medium cylinder 20 thus need not be pressure-actuated in this locked position.

Figure 4:
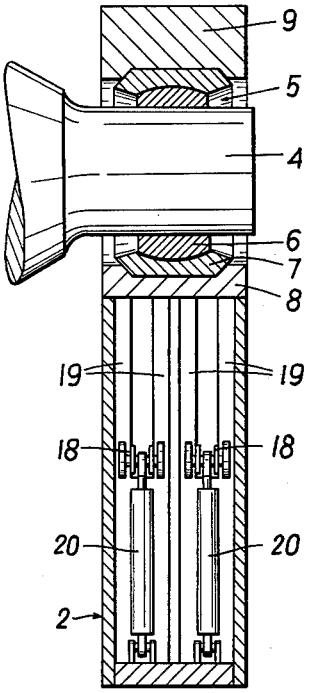

As can be seen from FIGS. 1 and 4, two adjacent drawing hooks are provided per bearing bushing bolting piece. Each of the drawing hooks is provided with a separate pressure medium cylinder 20 and can be brought into the engagement position by its cylinder. The bearing structure 2 is a box construction within which the shaft parts 16 of the drawing hooks 14 and their axes 17, as well as the push rods 18, the guides 19 the pressure medium cylinders 20 and the pressure medium cylinders 12, are housed and well protected.

Figure 6:
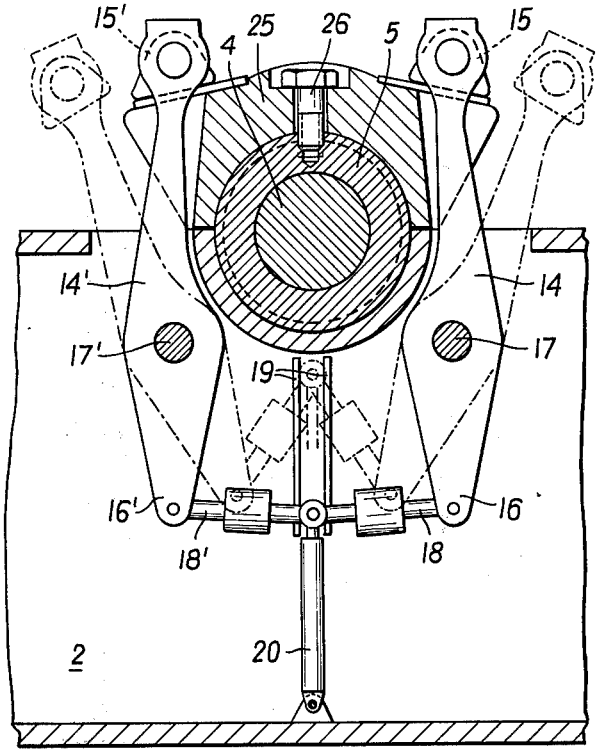
FIGS. 6 to 9 show a section analogous to FIG. 3, but each one for another embodiment of the invention.

FIG. 6 constitutes an embodiment in which the drawing hooks 14 and 14' are arranged symmetrically on both sides of the supporting trunnion. The shaft ends 16 and 16' of the two opposing drawing hooks 14 and 14', respectively, are articulately connected with one another by two push rods 18 and 18', respectively. The push rods are movable with their common joint along the track guide 19 by the pressure medium cylinder 20. In this embodiment, the bearing bushing bolting piece 25, which is also of symmetrical design, is not mounted on the bearing structure 2, but is connected with the bearing bushing 5 by a screw 26 so that the bearing bushing bolting piece 25 is detached together with the converter 1 from the bearing structure 2. The locked position is obtained in the same way as in the embodiment shown in FIG. 3.

Figure 7:
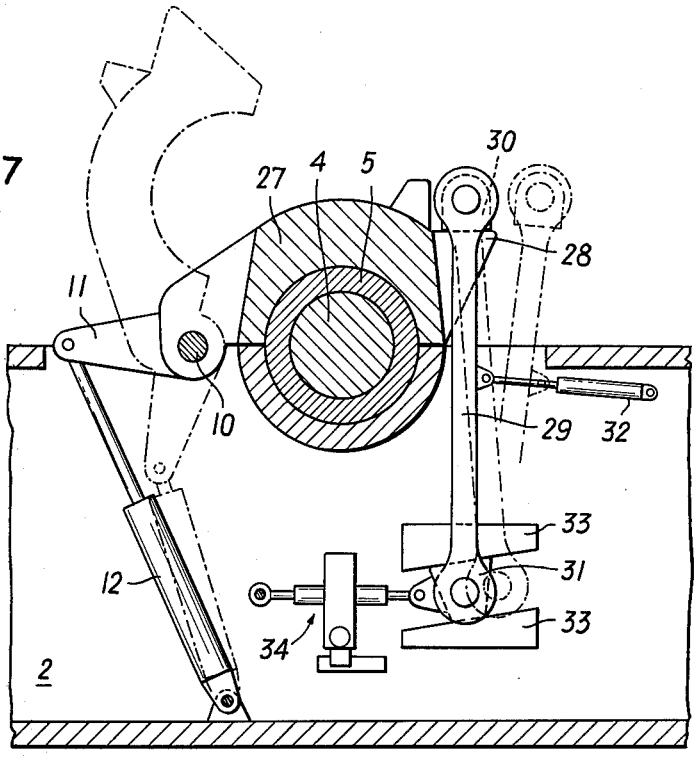
Figure 8:
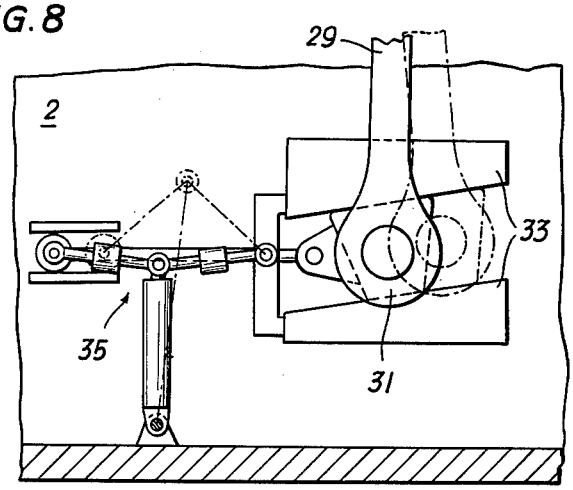

A preferred embodiment of the invention is shown in FIGS. 7 and 8. The bearing bushing bolting piece 27 is pivotally mounted on the bearing structure in the same way as the bearing bushing bolting piece 9 shown in FIG. 3. It has a bracket or console 28, to which the hook end 30 of a drawing hook 29 is movable by a pressure medium cylinder 32. The shaft-end 31 of the drawing hook 29 is guided in a guide 33 formed by two parallel faces, and the shaft end can be moved along the guide by means of a self-locking mechanical drive, 34 or 35. The converter is connected to the bearing structure by pivoting the drawing hook 29 into an engagement position with the console of the bearing bushing bolting piece by means of the pressure medium cylinder 32, which position is shown in FIGS. 7 and 8 in dot-and-dash lines. Whereupon the mechanical drive 34 or 35 moves the shaft end 31 of the drawing hook 29 along the guide 33 into a locked position which is shown in FIGS. 7 and 8 in full line. The locked position is reached only when the drawing hook is braced with its hook end 30 against the console 28. The mechanical drive 34 or 35 is dimensioned to be self-locking. In FIG. 7 a turnbuckle is shown as drive 34. The ends of the turnbuckle are articulately connected with the shaft end on the one hand and with the bearing structure on the other hand. FIG. 8 shows a knuckle joint movable beyond its straightened position and provided with springs as drive 35. The drives 34 and 35 are suitably hydraulically actuated.

Figure 9:
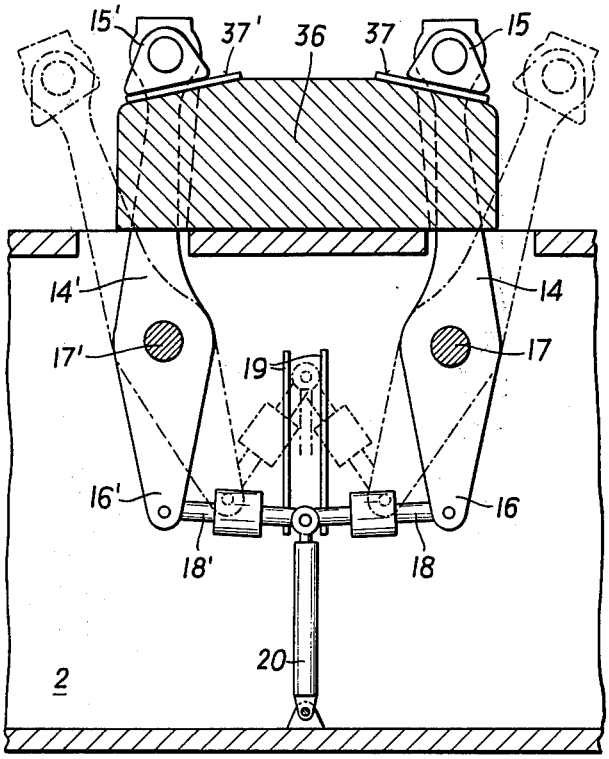

FIG. 9 is a modified embodiment of the invention in which the converter has claw-like consoles 36 connected to the converter wall as supporting elements, instead of the supporting trunnions and the bearing bushings. These consoles have inclined faces 37 and 37' with which the hook ends of the drawing hooks can be brought into and out of engagement. The configuration of the drawing hooks whose bearing as well as drive are suitably effected according to the embodiment shown in FIG. 6, can also be effected according to the modifications shown in FIGS. 7 and 8.

What we claim is:

1. In a tiltable converter having a converter body, supporting trunnions fixed to the converter body, a bearing structure surrounding the converter body for at least half of its circumference, bearing bushings releasably connected to the bearing structure for mounting engagement of the supporting trunnions, and drawing hooks for attaching the bearing bushings to the bearing structure and being pivotable into and out of an engagement position, the improvement comprising:

a bearing bushing bolting piece for each bearing bushing, said bolting piece being arranged for engagement and disengagement with at least one drawing hook so as to attach the bearing bushings to the bearing structure or to release them, respectively, said at least one drawing hook having a hook end and a shaft end with an axis therebetween, each drawing hook being arranged on the bearing structure so as to be pivotable around said axis, the hook end of the at least one drawing hook being pivotable into engagement with the bearing bushing bolting piece;

at least a first pressure medium cylinder allocated to each bearing bushing for actuating the at least one drawing hook, said first pressure medium cylinder having one side articulately connected to the bearing structure; and self-locking bracing means fastened to the bearing structure for releasably locking the at least one drawing hook in its engagement position, said self-locking bracing means includes a push rod for each drawing hook and a guide for the push rod, the shaft end of the drawing hook being hinged to one end of the push rod and the other end of the push rod being connected to the other end of the first pressure medium cylinder, the other end of the push rod also being guided in said guide and being movable along said guide into a locked position by means of said first pressure medium cylinder.

2. A tiltable converter as set forth in claim 1, further comprising a second pressure medium cylinder for bringing the bearing bushing bolting piece into and out of engagement position with the bearing bushing and wherein the bearing bushing bolting piece is pivotably arranged on the bearing structure.

3. A tiltable converter as set forth in claim 1, wherein said drawing hooks are arranged on both sides of the supporting trunnions, the shaft ends of two opposing drawing hooks being articulately connected by two push rods and further comprising a common joint for said two push rods, said common joint being movable along the guide by said first pressure medium cylinder means connected thereto so as to bring about a locked position.

4. A tiltable converter as set forth in claim 1, further comprising springs provided on the push rod and acting in the pressure direction, wherein, when the drawing hooks are in the engagement position, the push rod is movable beyond its dead position into a locked position in which it automatically inhibits movement of said drawing hooks.

5. In a tiltable converter having a converter body, supporting trunnions fixed to the converter body, a bearing structure surrounding the converter body for at least half of its circumference, bearing bushings releasably connected to the bearing structure for mounting engagement of the supporting trunnions, and drawing hooks for attaching the bearing bushing to the bearing structure and being pivotable into and out of an engagement position, the improvement comprising:

a bearing bushing bolting piece with a console arranged for engagement and disengagement with at least one drawing hook, said drawing hook having a hook end and a shaft end with the console of said bolting piece being in contact with the hook end when engagement occurs so as to attach the bearing bushings to the bearing structure;

at least one pressure medium cylinder allocated to each bearing bushing for actuating the at least one drawing hook, said at least one pressure medium cylinder having one side articulately connected to the bearing structure and its other side connected to the at least one drawing hook so as to adjust the hook end of each drawing hook relative to the console of the bearing bushing bolting piece;

a guide in which the shaft end of the drawing hook is movable; and a self-locking mechanical drive fastened to the bearing structure for releasably locking the at least one drawing hook in its engagement position by moving the shaft end of the drawing hook along said guide to a locked position.

6. A tiltable converter as set forth in claim 5, wherein said self-locking mechanical drive is a turnbuckle.

7. A tiltable converter as set forth in claim 5, wherein said self-locking mechanical drive is a knuckle lever.

8. A tiltable converter comprising;

a converter body;

a bearing structure surrounding the converter body for at least half of its circumference;

claw-like consoles connected to the converter body and serving as supporting elements of the converter;

fitting surfaces on the claw-like consoles;

drawing hooks arranged on both sides of the consoles, which drawing hooks are pivotable into and out of an engagement position with the fitting surfaces on the claw-like consoles, said drawing hooks having a hook end and a shaft end with the hook end engaging the console;

a pressure medium cylinder for actuating the drawing hooks, said pressure medium cylinder having one end articulately connected to the bearing structure; and self-locking bracing means for releasably locking the drawing hooks in their engagement position, said self-locking bracing means comprising a guide and two push rods, the push rods being connected together at a common joint and their other ends being articulately connected to the shank ends of the opposing drawing hooks, the common joint being connected to the other end of the pressure medium cylinder and being guided in said guide, said common point being movable along said guide into a locked position by means of said pressure medium cylinder.

* * * * *

UNITED STATES PATENT AND TRADEMARK OFFICE

CERTIFICATE OF CORRECTION

PATENT NO. : 4,049,249

DATED : September 20, 1977

INVENTOR(S) : Peter Moser et al

It is certified that error appears in the above-identified patent and that said Letters Patent are hereby corrected as shown below:

Col. 1, line 16, after "structure" insert --is made--;

Col. 2, line 51, "trunninons" should be --trunnions--;

Col. 2, line 54, after "sleeve" (second occurrence insert --7 -- and

Col. 3, line 23, change " ; " to -- - --.

Signed and Sealed this

*Tenth* Day of *January 1978*

[SEAL]

*Attest:*

RUTH C. MASON
*Attesting Officer*

LUTRELLE F. PARKER
*Acting Commissioner of Patents and Trademarks*